US006045983A

United States Patent [19]

Buitano et al.

[11] Patent Number: 6,045,983

[45] Date of Patent: Apr. 4, 2000

[54] COLOR NEGATIVE FILMS ADAPTED FOR DIGITAL SCANNING

[75] Inventors: Lois A. Buitano; Allan F. Sowinski, both of Rochester; Maria J. Gonzalez, Pittsford; Steven G. Link, Rochester, all of N.Y.

[73] Assignee: Eastman Kodak Company, Rochester, N.Y.

[21] Appl. No.: 09/129,269

[22] Filed: Aug. 5, 1998

Related U.S. Application Data

[63] Continuation-in-part of application No. 08/925,835, Sep. 5, 1997, abandoned.

[51] Int. Cl.[7] ..... G03C 1/46

[52] U.S. Cl. ..... 430/503; 430/567; 430/570

[58] Field of Search ..... 430/503, 567, 430/570

[56] References Cited

U.S. PATENT DOCUMENTS

| | | | |
|---|---|---|---|
| 3,672,898 | 6/1972 | Schwan et al. | 430/507 |
| 4,439,520 | 3/1984 | Kofron et al. | 430/434 |
| 5,275,929 | 1/1994 | Buitano et al. | 430/567 |
| 5,302,499 | 4/1994 | Merrill et al. | 430/503 |
| 5,322,766 | 6/1994 | Sowinski et al. | 430/505 |
| 5,609,978 | 3/1997 | Giorgianni et al. | 430/30 |

FOREIGN PATENT DOCUMENTS

| | | | |
|---|---|---|---|
| 566077 | 10/1993 | European Pat. Off. | G03C 1/005 |

*Primary Examiner*—Mark F. Huff
*Attorney, Agent, or Firm*—Carol O. Thomas

[57] ABSTRACT

A color negative film is disclosed capable of producing dye images suitable for digital scanning. With a green recording layer unit coated over a red recording layer unit a red exposure information containing dye image record is created that better matches human visual color perception when reversed to a positive that is red with unsought densities in the same spectral region as the red exposure information containing dye image attributable to blue and green recording layer units subtracted, by (a) withholding colored masking couplers from the recording layer units, (b) employing tabular grain emulsions with average aspect ratios of less than 15 in the green recording layer unit, and (c) placing spectral sensitizing dye in the red recording layer unit that exhibits an overall half-peak absorption bandwidth of at least 50 nm bridging the green and red regions of the spectrum, with absorption at 560 nm being in the range of from 80 to 95 percent of maximum absorption, which is located in the spectral region of from 575 to 710 nm.

7 Claims, No Drawings

COLOR NEGATIVE FILMS ADAPTED FOR DIGITAL SCANNING

This is a continuation-in-part of U.S. Ser. No. 08/925,835, filed Sep. 5, 1997, now abandoned.

FIELD OF THE INVENTION

The invention is directed to color negative films intended to be digitally scanned.

DEFINITION OF TERMS

In referring to grains and emulsions containing two or more halides, the halides are named in order of ascending concentrations.

The terms "high chloride" and "high bromide" in referring to grains and emulsions indicate that chloride or bromide, respectively, is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The terms "blue spectral sensitizing dye", "green spectral sensitizing dye", and "red spectral sensitizing dye" refer to a dye or combination of dyes that sensitize silver halide grains and, when adsorbed, have their peak absorption in the blue, green and red regions of the spectrum, respectively.

The term "half-peak bandwidth" in referring to a dye indicates the spectral region over which absorption exhibited by the dye is at least half its absorption at its wavelength of maximum absorption.

In referring to blue, green and red recording dye image forming layer units, the term "layer unit" indicates the layer or layers that contain radiation-sensitive silver halide grains to capture exposing radiation and that contain couplers that react upon development of the grains. The grains and couplers are usually in the same layer, but can be in adjacent layers.

The term "overall half-peak bandwidth" indicates the spectral region over which a combination of spectral sensitizing dyes within a layer unit exhibits absorption that is at least half their combined maximum absorption at any single wavelength.

The term "colored masking coupler" indicates a coupler that is initially colored and that loses its initial color during development upon reaction with oxidized color developing agent.

The term "Status M" density indicates density measurements obtained from a densitometer meeting photocell and filter specifications described in *SPSE Handbook of Photographic Science and Engineering*, W. Thomas, editor, John Wiley & Sons, New York, 1973, Section 15.4.2.6 Color Filters. The International Standard for Status M density is set out in "Photography—Density Measurements—Part 3: Spectral conditions", Ref. No. ISO 5/3-1984(E).

*Research Disclosure* is published by Kenneth Mason Publications, Ltd., Dudley House, 12 North St., Emsworth, Hampshire P010 7DQ, England.

BACKGROUND

Color negative photographic elements are conventionally formed with superimposed blue, green and red recording layer units coated on a support. The blue, green and red recording layer units contain radiation-sensitive silver halide emulsions that form a latent image in response to blue, green and red light, respectively. Additionally, the blue recording layer unit contains a yellow dye-forming coupler, the green recording layer unit contains a magenta dye-forming coupler, and the red recording layer unit contains a cyan dye-forming coupler. Following imagewise exposure, the photographic elements are processed in a color developer, which contains a color developing agent that is oxidized while selectively reducing to silver latent image bearing silver halide grains. The oxidized color developing agent then reacts with the dye-forming coupler in the vicinity of the developed grains to produce an image dye. Yellow (blue-absorbing), magenta (green-absorbing) and cyan (red-absorbing) image dyes are formed in the blue, green and red recording layer units respectively. Subsequently the element is bleached (i.e., developed silver is converted back to silver halide) to eliminate neutral density attributable to developed silver and then fixed (i.e., silver halide is removed) to provide stability during subsequent room light handling.

When processing is conducted as noted above, negative dye images are produced. To produce corresponding positive dye images and hence to produce a visual approximation of the hues of the subject photographed, white light is typically passed through the color negative image to expose a second color photographic element having blue, green and red recording layer units as described above, usually coated on a white reflective support. The second element is commonly referred to as a color print element. Processing of the color print element as described above produces a viewable positive image that approximates that of the subject originally photographed.

A problem with the accuracy of color reproduction delayed the commercial introduction of color negative elements. In color negative imaging two dye-forming coupler containing elements are exposed and processed to arrive at a viewable positive image. The dye-forming couplers each produce dyes that only approximate an absorption profile corresponding to that recorded by the silver halide grains. Since the color negative element cascades its color errors forward to the color print element, the cumulative error in the final print is unacceptably large, absent some form of color correction.

A commercially acceptable solution that remains in use today in the form of color slides is to subject a color photographic element similar to the color negative element described above to reversal processing. In reversal processing the film is first black-and-white processed to develop exposed silver halide grains imagewise without formation of a corresponding dye image. Thereafter, the remaining silver halide grains are rendered developable. Color development followed by bleaching produces a viewable color image corresponding to the subject photographed. The primary objections to this approach are (a) the more complicated processing required and (b) the absence of an opportunity to correct underexposures and overexposures, as is provided during exposure of a print element.

The complicated processing can be eliminated by substituting direct positive emulsions for the negative-working silver halide emulsions conventionally present in color reversal films. Unfortunately, direct positive emulsions are more difficult to manufacture, exhibit lower levels of sensitivity at comparable granularity, and have unique problems of their own, such as re-reversal, that have almost entirely foreclosed their use as replacements for negative-working emulsions.

Commercial acceptance of color negative elements occurred after commercial introduction of the first color reversal films. The commercial solution to the problem has been to place colored masking couplers in the color negative element. The colored masking couplers lose their color in areas in which grain development occurs, producing a dye image that is a reversal of the unwanted absorption of the image dye. This has the effect of neutralizing unwanted spectral absorption by the image dyes by raising the neutral density of the processed color negative element. However, this is not a practical difficulty, since this is easily offset by increasing exposure levels when exposing the print element through the color negative element.

In this regard, it should be noted that colored masking couplers have no applicability to reversal color elements. They actually increase visually objectionable dye absorption in a color negative film, superimposing an overall salmon colored tone, which can be tolerated only because color negative images are not intended to be viewed. On the other hand, color reversal images are made to be viewed, but not printed. Thus colored masking couplers, if incorporated in reversal films, would be visually objectionable and serve no useful purpose.

Radiation-sensitive silver halide grains possess native sensitivity to the near ultraviolet region of the spectrum, and high bromide silver halide grains possess significant levels of blue sensitivity. Blue recording layer units often rely on the native sensitivity of the high bromide silver halide emulsions they contain for light capture. Blue recording layer units sometimes and green and red recording layer units always employ spectral sensitizing dyes adsorbed to silver halide grain surfaces to absorb light and to transfer exposure energy to the radiation-sensitive silver halide grains. In a simple textbook model the light absorbed in each of the blue, green and red recording layer units is limited to just that one region of the spectrum. For blue, green and red recording layer units light absorption in the blue (400 to 500 nm), green (500 to 600 nm) and red (600 to 700 nm) spectral region, respectively, is sought with no significant absorption in any other region of the visible spectrum.

In practice each spectral sensitizing dye exhibits a peak (occasionally a dual peak) absorption wavelength and absorption declines progressively as exposure wavelengths diverge from the peak. Thus, considerable effort has gone into selecting spectral sensitizing dyes and dye combinations that best serve practical imaging needs, recognizing that uniform absorption over a 100 nm blue, green or red segment of the visible spectrum is impossible to realize, even when dye combinations are employed.

Schwan et al U.S. Pat. No. 3,672,898 and Giorgianni et al U.S. Pat. No. 5,609,978 and U.S. Pat. No. 5,582,961 are illustrative of attempts to improve color reproduction by intentionally selecting spectral sensitizing dyes for red recording layer units that exhibit significant absorption in the green portion of the spectrum. Giorgianni et al '978 and '961 are herein incorporated by reference.

The use of spectrally sensitized tabular grain emulsions in the minus blue recording layer units of color photographic elements has been demonstrated by Kofron et al U.S. Pat. No. 4,439,520 to improve image sharpness and to increase speed in relation to granularity. Kofron et al demonstrates that improvements in performance are realized as the average aspect ratios of the tabular grain emulsions are increased.

SUMMARY OF THE INVENTION

In one aspect the invention is directed to a color negative film capable of producing dye images suitable for digital scanning comprised of a support and, coated on the support, a blue recording emulsion layer unit capable of forming a dye image of a first hue, a green recording emulsion layer unit capable of forming a dye image of a second hue, and, located between the support and the green recording layer unit, a red recording emulsion layer unit capable of forming a dye image of a third hue, wherein, to produce a third hue dye image record that better matches human visual color perception when unsought third hue densities attributable to the blue and green recording layer units are subtracted and the resulting third hue dye image is reversed to a corresponding positive image that is red, colored masking couplers are absent from the recording layer units, tabular grain silver halide emulsions sensitized to the green and red are employed in the green and red recording layer units, respectively, the tabular grain emulsions in the green recording layer unit have an average aspect ratio of less than 15, and spectral sensitizing dye in the red recording layer unit exhibits an overall half-peak absorption bandwidth of at least 50 nm bridging the green and red regions of the spectrum, with absorption at 560 nm being in the range of from 80 to 95 percent of maximum absorption, which is located in the spectral region of from 575 to 710 nm.

DESCRIPTION OF PREFERRED EMBODIMENTS

A typical color negative film construction useful in the practice of the invention is illustrated by the following:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| S | Support |
| AHU | Antihalation Layer Unit |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Transparent and reflective support constructions, including subbing layers to enhance adhesion, are disclosed in *Research Disclosure*, Vol. 389, September 1996, Item 38957.

The blue recording layer unit BU contains at least one silver halide emulsion for recording exposure to blue light and yellow dye-forming coupler, but does not contain colored masking coupler. The silver halide emulsion or emulsions contained in BU can be either tabular grain or non-tabular grain emulsions. One or more blue spectral sensitizing dyes are preferably adsorbed to the surfaces of the radiation-sensitive silver halide grains in BU, particularly when tabular grain emulsions are employed. When high bromide radiation-sensitive silver halide grains are employed, the native blue sensitivity of the silver halide grains can be relied upon to capture blue exposures. BU can take the form of a single layer or can be divided into two, three or more layers. Dye-forming coupler and radiation-sensitive grains are preferably present in all layers, but it is recognized that couplers are functional when located in reactive association with the radiation-sensitive grains in an adjacent layer.

The green recording layer unit GU contains at least one green sensitized silver halide emulsion and magenta dye-forming coupler, but does not contain colored masking coupler. The silver halide emulsion or emulsions contained in GU are tabular grain emulsions having an average aspect ratio of less than 15 and preferably less than 12. A preferred minimum average aspect ratio is at least 5. By limiting average aspect ratios as indicated it is possible to achieve the advantages of this invention while still realizing other known significant advantages of tabular grain emulsions over non-tabular grain emulsions. One or more green spectral sensitizing dyes are contained in the tabular grain emulsions and absorbed to grain surfaces. GU can take the form of a single layer or can be divided into two, three or more layers. Dye-forming coupler and green sensitized radiation-sensitive grains are preferably present in all layers, but it is recognized that couplers are functional when located in reactive association with the radiation-sensitive grains in an adjacent layer. The details of GU construction, including any optional addenda, can, except as noted above, take any convenient conventional form.

The red recording layer unit RU contains at least one red sensitized silver halide emulsion and cyan dye-forming coupler, but does not contain colored masking coupler. The silver halide emulsion or emulsions contained in RU are tabular grain emulsions. The average aspect ratios of the tabular grain emulsions in the red recording layer unit are not critical to the improvement of the red record sought by the present invention. However, it is generally recognized in the art that increasing the average aspect ratio of tabular grain emulsions increases most tabular grain performance characteristics. Therefore, to realize known tabular grain emulsion advantages, it is preferred that the tabular grain emulsions in RU have an average aspect ratio of at least 5 and, in most instances, a higher average aspect ratio than the tabular grain emulsions in GU. Thus, average aspect ratios for the tabular grain emulsions in RU of greater than 15 (most preferably at least 20) are specifically contemplated.

Red spectral sensitizing dyes are adsorbed to grain surfaces in the tabular grain emulsions contained in RU. The red spectral sensitizing dyes provide an overall half-peak absorption bandwidth of at least 50 nm and preferably at least 75 nm that bridges the green and red regions of the spectrum.

RU can take the form of a single layer or can be divided into two, three or more layers. Dye-forming coupler and radiation-sensitive grains are preferably present in all layers, but it is recognized that couplers are functional when located in reactive association with the radiation-sensitive grains in an adjacent layer.

It has been discovered quite unexpectedly that the combination of green and blue recording layer unit constructions described above allows a cyan dye record to be created that better matches human visual color perception when retrieved by digital scanning, reversed to red, and corrected for blue and green recording layer unit contributions to red densities.

The color correction that is normally achieved by the presence of colored masking couplers can be achieved by manipulating digitally stored image information retrieved by scanning. To do this samples of the color negative film of the invention are exposed through a step tablet in separate areas to blue, green and red light, processed and then measured for blue, green and red density in each area of exposure. The red densities in the areas receiving only blue and green exposure provide a reference for determining the proportion red density in a film exposed to white light that is attributable to unwanted red absorption by yellow and magenta image dyes. By subtracting the red absorption attributable to the yellow and magenta image dyes, a corrected red record is obtained that accurately reflects the exposure of the red recording layer unit element.

Whereas it has been thought immaterial whether the color correction of color negative films intended for scanning is undertaken by correction of the digitally stored image information or through, as is traditional, the incorporation of colored masking couplers, it has been discovered quite unexpectedly that a better match of human visual color perception in the red record can more readily be achieved by eliminating colored masking couplers in combination with the selections noted above of (1) green recording layer unit tabular grain emulsion average aspect ratios and (2) red recording layer unit overall half-peak absorption bandwidths.

Specifically, with the unique combination of features described above, it is possible to achieve in the red recording layer unit a sensitivity to light at 560 nm that is in the range of from 80 to 95 percent of the maximum sensitivity to light in the spectral region of from 575 to 710 nm. This ability to extend the sensitivity of the red recording layer unit into the green region of the spectrum offers to the color negative elements of the invention a red sensitivity that better matches the sensitivity of the red receptors in the human retina. This allows color images to be obtained that, when viewed, are perceived by the viewer to be truer recreations of the colors of the subject photographed.

Thus, the invention produces a desirable end result for imaging systems in which a color negative film according to the invention is relied upon for image capture. In use, the color negative film of the invention is imagewise exposed and then processed to produce dye images in the blue, green and red recording layer units. The processed film is scanned pixel by pixel for red, green and blue densities, with the information obtained being stored in a digital computer memory. By using color correction information, such as that described above obtained by exposure of film samples, or by using appropriate values established from prior experience, the blue, green and red densities of each pixel are corrected by subtraction. The corrected blue, green and red pixel densities are then used to generate a video signal, to control an exposure source (such as separate blue, green and red emitting photodiodes or lasers) for exposing a color print element, to generate instructions for a color printer (such as a thermal dye transfer printer), or any other conventional digital to visual image conversion.

The details of BU, GU and RU constructions, including any optional addenda, can, except as noted above, take any convenient conventional form. Typically each layer contains at least one radiation-sensitive silver halide emulsion containing chemically sensitized silver halide grains, spectral sensitizing dye adsorbed to the grain surfaces, and antifoggants and/or stabilizers, blended with at least one dye image-forming coupler (often in combination with one or more other imaging performance modifying couplers) dissolved in latex or high boiling liquid (coupler solvent) particles suspended in vehicle.

Radiation-sensitive silver halide emulsions useful in the practice of the invention can be selected from among those disclosed in *Research Disclosure*, Item 38957, I. Emulsion grains and their preparation. Both high chloride and high bromide emulsions are within the contemplation of the invention. High bromide emulsions are employed in the majority of color negative applications and are therefore preferred. Since higher speeds in relation to granularity can be realized by incorporating iodide in the grains, it is usually preferred to incorporate a minor proportion of iodide, typically from about 0.5 to 15 (optimally 1.0 to 10) mole percent, based on silver, in high bromide grains. Chloride can be included in the high bromide grains, but is usually limited to less than about 5 mole percent, based on silver.

The non-tabular grains can be of any convenient shape. Regular grains having {100} and/or {111} crystal faces, such as cubes, octahedra and cubo-octahedra, are contemplated. Irregular grains, such as ammoniacally prepared grains and single or multiply twinned grains, are also contemplated.

In the tabular grain emulsions, the tabular grains preferably account for at least 70 (most preferably 90) percent of total grain projected area. Preferably the tabular grains have thicknesses of less than 0.3 $\mu$m. Ultrathin tabular grain emulsions (those with mean grain thicknesses of less than 0.07 $\mu$m) are specifically contemplated.

Mean grain size (ECD) of the tabular grain emulsions is selected to provide the desired balance of speed and granularity for the imaging application. Useful mean ECD's are conventionally less than 10 $\mu$m and, in practice, rarely exceed 5 $\mu$m.

The average aspect ratio of the tabular grain emulsions are a function of the mean ECD of the tabular grains and their mean thickness. Typically tabular grain precipitation conditions are adjusted to obtain a convenient tabular grain thickness. As tabular grain growth progresses the mean ECD of the tabular grains increases with little, if any, increase in tabular grain thickness. Grain growth is terminated when an optimum mean ECD and average aspect ratio of the tabular grains has reached a level of optimum for the imaging application. It is specifically contemplated to allow grain thickness to increase during tabular grain growth to allow a selected ECD to be realized where limited average aspect ratios are sought.

Preferred high bromide tabular grain emulsions contemplated for use in the practice of this invention are illustrated by the following patents, here incorporated by reference:

Solberg et al U.S. Pat. No. 4,433,048;
Wilgus et al U.S. Pat. No. 4,434,226;
Kofron et al U.S. Pat. No. 4,439,520;
Maskasky U.S. Pat. No. 4,435,501;
Maskasky U.S. Pat. No. 4,713,320;
Nottorf U.S. Pat. No. 4,722,886;
Saito et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Piggin et al U.S. Pat. No. 5,061,616;
Piggin et al U.S. Pat. No. 5,061,616;
Bell et al U.S. Pat. No. 5,132,203;
Antoniades et al U.S. Pat. No. 5,250,403;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Black et al U.S. Pat. No. 5,219,720;
Black et al U.S. Pat. No. 5,334,495;
Tsaur et al U.S. Pat. No. 5,272,048;
Delton U.S. Pat. No. 5,310,644;
Chaffee et al U.S. Pat. No. 5,358,840;
Delton U.S. Pat. No. 5,372,927;
Delton U.S. Pat. No. 5,460,934;
Wen U.S. Pat. No. 5,470,698;
Fenton et al U.S. Pat. No. 5,476,760;
Mignot U.S. Pat. No. 5,484,697;
Maskasky U.S. Pat. No. 5,492,801;
Daubendiek et al U.S. Pat. No. 5,494,789;
Olm et al U.S. Pat. No. 5,503,970;
Daubendiek et al U.S. Pat. No. 5,503,971;
King et al U.S. Pat. No. 5,518,872;
Wen et al U.S. Pat. No. 5,536,632;
Daubendiek et al U.S. Pat. No. 5,573,902;
Daubendiek et al U.S. Pat. No. 5,576,168;
Olm et al U.S. Pat. No. 5,576,171;
Olm et al U.S. Pat. No. 5,576,172;
Deaton et al U.S. Pat. No. 5,582,965;
Maskasky U.S. Pat. No. 5,604,085;
Reed et al U.S. Pat. No. 5,604,086;
Maskasky U.S. Pat. No. 5,620,840; and
Eshelman et al U.S. Pat. No. 5,612,175.

Chemical sensitization of silver halide emulsions is illustrated by *Research Disclosure*, Item 38957, IV. Chemical sensitization, and by the patents incorporated by reference above. Spectral sensitizing dyes are illustrated by *Research Disclosure*, Item 38957, V. Spectral sensitization and desensitization A. Sensitizing dyes, and by the patents incorporated by reference above (note Kofron et al particularly). Antifoggants and stabilizers are illustrated by *Research Disclosure*, Item 38957, VII Antifoggants and stabilizers.

Couplers, including dye-forming couplers and other image modifying couplers, suitable for use in BU, GU and RU are illustrated in the patents incorporated by reference above and in *Research Disclosure*, Item 38957, X. Dye image formers and modifiers.

The vehicle and related addenda for the layers of BU, GU and RU as well as the remaining processing solution permeable layers of the color negative element can be selected from among the vehicles disclosed in the patents incorporated by reference above and *Research Disclosure*, Item 38957, II. Vehicles, vehicle extenders, vehicle-like addenda and vehicle related addenda. Generally, hardened gelatin and gelatin derivatives are preferred vehicles; however, cationic starch and, particularly, oxidized cationic starch, disclosed by Maskasky U.S. Pat. Nos. 5,604,085, 5,620,840, 5,633,127, 5,667,955, and 5,733,718.

The remaining elements SOC, IL1, IL2 and AHU of the element SCN-1 are optional and can take any convenient conventional form.

The interlayers IL1 and IL2 are hydrophilic colloid layers having as their primary function stain reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate an oxidized developing agent scavenger. When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. IL2 can also contain a yellow filter. Suitable yellow filter dyes can be selected from among those illustrated by *Research Disclosure*, Item 38957, VIII. Absorbing and scattering materials, B. Absorbing materials. Antistain agents (oxidized developing agent scavengers) can be selected from among those disclosed by *Research Disclosure*, Item 38957, X. Dye image formers and modifiers, D. Hue modifiers/stabilization, paragraph (2).

The antihalation layer unit AHU typically contains a processing solution removable or decolorizable light absorbing material, such as one or a combination of pigments and dyes. Suitable materials can be selected from among those disclosed in *Research Disclosure*, Item 38957, VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure*, Item 38957, IX. Coating physical property modifying addenda. The SOC overlying the emulsion layers additionally preferably contains an ultraviolet absorber, such as illustrated by *Research Disclosure*, Item 38957, VI. UV dyes/optical brighteners/luminescent dyes, paragraph (1).

Instead of the layer unit sequence of element SCN-1, alternative layer units sequences can be employed and are particularly attractive when high chloride rather than high bromide emulsions are employed. The following alternative layer order arrangements are specifically contemplated:

| Element SCN-2 |
|---|
| SOC\|GU\|IL1\|RU\|IL2\|BU\|S\|AHU\|SOC |
| and |
| Element SCN-3 |
| SOC\|GU\|IL1\|BU\|IL2\|RU\|S\|AHU\|SOC |

In SCN-2 yellow filter is omitted from IL1 or IL2. In SCN-3 yellow filter is omitted from IL1. Aside from the noted differences, elements SCN-2 and SCN-3 are generally similar to SCN-1.

It is recognized that any one of the blue (BU), green (GU) and red (RU) recording layer units of SCN-1, SN-2 and SN-3 can be made up of plural emulsion layers differing in speed. Color negative photographic elements that employ a single red recording emulsion layer, a single green recording emulsion layer, and a single blue recording emulsion layer are commonly referred to as "single coated". It has been long recognized that an improved speed-granularity relationship can be realized in color negative elements by dividing each of the red, green and blue recording layer units into layer units differing in speed when the emulsion layers within a layer unit are arranged to receive exposing radiation in the order of their relative speeds, starting with the faster or fastest emulsion layer. When the coating order is reversed—that is the slower or slowest emulsion layer within a layer unit first receives exposing radiation, the result is higher contrast. Color negative photographic elements having layer units divided into two layer units for recording in the same region of the spectrum are commonly referred to as "double coated". Color negative photographic elements having layer units divided into three layer units for recording in the same region of the spectrum are commonly referred to as "triple coated".

The color negative elements of the invention can be imagewise exposed in any convenient conventional manner. The imagewise exposed color negative elements can be processed using conventional color developer compositions and color negative processing systems. Such compositions and systems are included among those disclosed in *Research Disclosure*, Item 38957, XVIII. Chemical development systems, B. Color-specific processing systems, XIX. Development, and XX. Desilvering, washing, rinsing and stabilizing.

Though constructed with a unique combination of features to permit superior dye images to be formed for viewing following image retrieval by digital scanning, in the embodiments described above the color negative films of the invention have been described in terms of the most frequently selected components of color negative elements intended to be used for imagewise exposure of color print elements. Numerous alternative component selections are known and compatible with the practice of this invention.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure*, Item 38957, X. Dye image formers and modifiers, A. Silver dye bleach.

It is also well known that preformed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in Polaroid™ dye image transfer systems. These and other image transfer systems compatible with the practice of the invention are disclosed in *Research Disclosure*, Vol. 176, December 1978, Item 17643, XXIII. Image transfer systems.

One of the advantages of incorporating a color negative element in an image transfer system is that processing solution handling during photographic processing is not required. A common practice is to encapsulate a developer in a pod. When the image transfer unit containing the pod is passed between pressure rollers, developing agent is released from the pod and distributed over the uppermost processing solution permeable layer of the film, followed by diffusion into the recording layer units.

Similar release of developer is possible in color negative elements according to the invention intended to form only a retained dye image. Prompt scanning at a selected stage of development can obviate the need for subsequent processing. For example, it is specifically contemplated to scan the film as it passes a fixed point after passing between a set of pressure (optionally heated) rollers to distribute developing agent for contact with the recording layer units. If silver coating coverages are low, as is feasible with low maximum density images and, particularly, dye image amplification systems [illustrated by *Research Disclosure*, Item 38957, XVIII. Chemical development systems, B. Color-specific processing systems, paragraphs (5) through (7)], the neutral density of developed silver need not pose a significant impediment to the scanning retrieval of dye image information.

It is possible to minimize or even eliminate reliance on bringing a processing agent into contact with the recording layer units for achieving development by relying on heat to accelerate or initiate processing. Color negative elements according to the invention contemplated for processing by heat can be elements, such as those containing i) an oxidation-reduction image-forming combination, such as described by Sheppard et al U.S. Pat. No. 1,976,302, Sorensen et al U.S. Pat. No. 3,152,904, Morgan et al U.S. Pat. No. 3,846,136; ii) at least one silver halide developing agent and an alkaline material and/or alkali release material, as described in Stewart et al U.S. Pat. No. 3,312,550, Yutzy et al U.S. Pat. No. 3,392,020; or iii) a stabilizer or stabilizer precursor, as described in Humphlett et al U.S. Pat. No. 3,301,678, Haist et al U.S. Pat. No. 3,531,285 and Costa et al U.S. Pat. No. 3,874,946. These and other silver halide photothermographic imaging systems that are compatible with the practice of this invention are also described in greater detail in *Research Disclosure*, Vol. 170, June 1978, Item 17029. More recent illustrations of silver halide photothermographic imaging systems that are compatible with this invention are illustrated by levy et al UK 2,318,645, published Apr. 29, 1998, and Japanese Kokai (published application) 98/0133325, published May 22, 1998, and Ishikawa et al EPO 0 800 114 A2, published Oct. 8, 1997.

In the foregoing discussion the formation of yellow, magenta and cyan dye images to record blue, green and red exposures, respectively, is described, as is conventional in color negative elements intended to produce dye images for exposing color print elements. However, the color negative elements are intended to produce dye images for retrieval by scanning rather than printing. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. When the color negative image obtained by exposure and processing is intended to be retrieved by scanning, it is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half peak bandwidth in any other convenient region of the spectrum, ranging from the near ultraviolet (300–400 nm) through the visible and through the near infrared (700–1200 nm), so long as the absorption half peak bandwidths of the image dye in the layer units extend non-coextensive wavelength ranges. Preferably each image dye exhibits an absorption half-peak bandwidth that extends over at least a 25 (most preferably 50) nm spectral region that is not occupied by an absorption half-peak bandwidth of another image dye. Ideally the image dyes exhibit absorption half-peak bandwidths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half peak bandwidth that lies in a different spectral region than the dye images of the other emulsion layers of the layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.5 are contemplated and exposure latitudes of up to about 5.0 log E or higher are feasible.

A number of modifications of color negative elements have been suggested for accommodating scanning, as illustrated by *Research Disclosure*, Item 38957, XIV. Scan facilitating features. These systems to the extent compatible with the color negative element constructions described above are contemplated for use in the practice of this invention. The retained silver and reflective (including fluorescent) interlayer constructions of paragraph (1) are not preferred. The features of paragraphs (2) and (3) are generally compatible with the preferred forms of the invention.

To avoid burdensome repetition of what is well known to those skilled in the art, this disclosure extends to the publications cited above (including the further publications therein identified) to show features compatible with the practice of the invention.

EXAMPLES

The invention can be better appreciated by reference to the following specific embodiments. All coating coverages are reported in parenthesis in terms of g/m$^2$, except as otherwise indicated. Silver halide coating coverages are reported in terms of silver. The suffix (c) indicates a comparative control while the suffix (e) indicates an example of the invention.

Glossary of Acronyms

HBS-1 Tritoluoyl phosphate
HBS-2 Di-n-butyl phthalate
HBS-3 N-n-Butyl acetanilide
HBS-4 Tris(2-ethylhexyl) phosphate
HBS-5 Di-n-butyl sebacate
HBS-6 N,N-Diethyl lauramide

ST-1

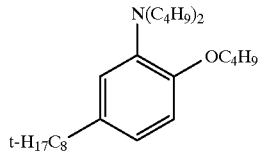

C-1

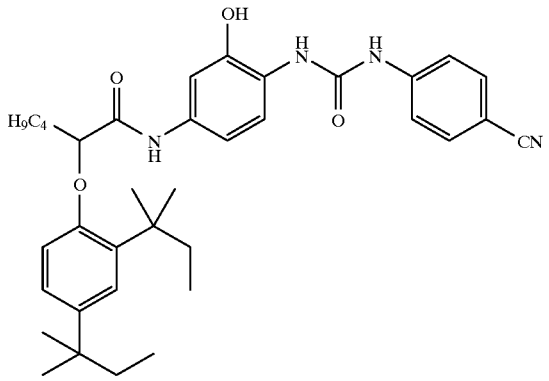

5
-continued
C-2
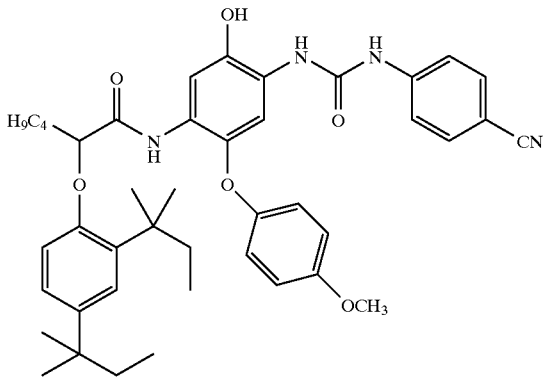
M-1
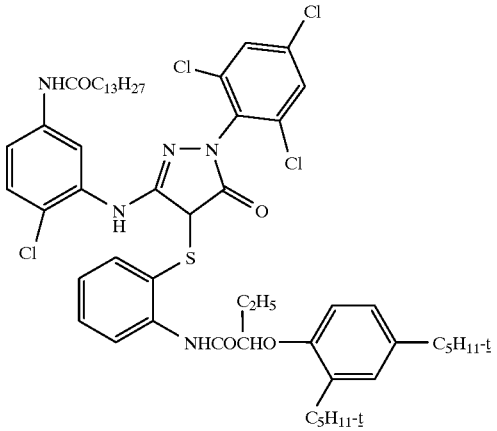
Y-1
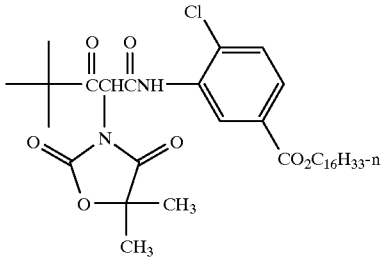
D-1
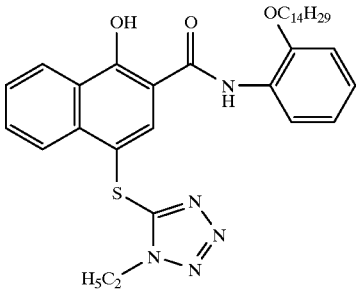
D-2
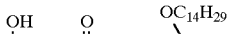

SD-01 Anhydro-9-ethyl-5',6'-dimethoxy-5-phenyl-3'-(3-sulfobutyl)-3-(3-sulfopropyl)oxathiacarbo-cyanine hydroxide SD-02 Anhydro-5,5'-dichloro-9-ethyl-3,3'-bis(3-sulfopropyl)thiacarbocyanine hydroxide SD-03 Anhydro-5',6'-dimethyl-11-ethyl-3'-(2-sulfo-ethyl)-3-(3-sulfopropyl)naphtho[1,2-d]-thiazolooxacarbocyanine tetramethyl guanidinium salt SD-04 Anhydro-9-ethyl-3'-methylsulfonylcarbamoylmethyl-5-phenyl-3-(sulfopropyl)-oxathiacarbocyanine hydroxide, triethyl ammonium salt SD-05 Anhydro-3,9-diethyl-3'-methylsulfonylcarbamoylmethyl-5-phenyloxathiocarbocyanine hydroxide SD-06 Anhydro-9-ethyl-3,3'-di(3-sulfopropyl)-4,5,4',5'-dibenzothiacarbocyanine hydroxide, sodium salt SD-07 Anhydro-5-chloro-9-ethyl-5'-phenyl-3'-(3-sulfobutyl)-3-(3-sulfopropyl)oxacarbocyanine hydroxide, sodium salt SD-08 Anhydro-3,3'-bis(3-sulfopropyl)-5'-chloro-5-phenyloxathiacyanine hydroxide, triethylammonium salt SD-09 Anhydro-5,5'-dichloro-3,3'-di-(3-sulfopropyl) thiacyaninehydroxide, triethylammonium salt SD-10 Anhydro-5,6-dimethoxy-5'-phenyl-3,3'-di-(3-sulfopropyl)thiacyanine hydroxide, triethylammonium salt SD-11 Anhydro-6,6'-dichloro-1,1'diethyl-3,3'-di-(3-sulfopropyl)-5,5'-bis(trifluoromethyl)benz-imidazolocarbocyanine hydroxide, triethylammonium salt TAI 4-Hydroxy-6-methyl-1,3,3a,7-tetraazaindene, sodium salt

SINGLE EMULSION LAYER

BLUE, GREEN AND RED RECORDING LAYER UNIT ELEMENTS

COMPONENT PROPERTIES

A silver iodobromide tabular grain emulsion was provided. The emulsion had an iodide content of 3.9 mole percent, based on silver. The mean ECD of the emulsion was 4.11 $\mu$m, the average thickness of the tabular grains was 0.128 $\mu$m, and the average aspect ratio of the tabular grains was 32.1. Tabular grains accounted for greater than 90% of the total grain projected area.

The emulsion was optimally sensitized using sodium thiocyanate, 3-(N-methylsulfonyl)carbamoyl-ethylbenzothiazolium tetrafluoroborate at 0.75 mmole of dye per mole of silver, sodium aurous (I) dithiosulfate dihydrate, and sodium thiosulfate pentahydrate.

Photographic samples 101 through 107 were prepared using single spectral sensitizing dyes SD-01 through SD-07 during the sensitization, as shown in Table I.

A transparent film support of cellulose triacetate with conventional subbing layers was provided for coating. The side of the support to be emulsion coated received an undercoat layer of gelatin (4.9). The reverse side of the support was comprised of dispersed carbon pigment in a non-gelatin binder (Rem Jet).

The coatings were prepared by applying the following layers in the sequence set out below to the support: Hardener H-1 was included at the time of coating at 1.80% by weight of total gelatin, including the undercoat, but excluding the previously hardened gelatin subbing layer forming a part of the support. Surfactant was also added to the various layers as is commonly practiced in the art.

| Layer 1: Light-Sensitive Layer | |
|---|---|
| Sensitized Emulsion silver | (1.08) |
| Cyan dye forming coupler C-1 | (0.97) |
| HBS-2 | (0.97) |
| Gelatin | (3.23) |
| TAI | (0.017) |
| **Layer 2: Gelatin Overcoat** | |
| Gelatin | (4.30) |

The dispersed carbon pigment on the back of the coating was removed with methanol. The light transmittance and reflectance of the sample was measured using a spectrophotometer over the visible light range (360 to 700 nanometers) at two nanometer wavelength increments. The total reflectance (R) is the fraction of light reflected from the coating, measured with an integrating sphere which includes all light exiting the coating regardless of angle. The total transmittance (T) is the fraction of light transmitted through the coating regardless of angle. The total absorptance (A) of the coating is determined from the measured total reflectance and total transmittance using the equation A=1−R−T. The wavelength of peak light absorption and the half-peak bandwidth of the light absorption (difference in wavelengths at which absorptance is half of the peak value) was then determined from the total absorptance data.

TABLE I

Characteristics of Sensitizing Dyes: Peak Wavelength and Half-peak Bandwidth

| Photographic Sample | Sensitizing Dye | Wavelength of Maximum Absorption (nm) | Half-peak Bandwidth (nm) |
|---|---|---|---|
| 101 | SD-01 | 604 | 26 |
| 102 | SD-02 | 654 | 22 |
| 103 | SD-03 | 611 | 20 |
| 104 | SD-04 | 587 | 21 |
| 105 | SD-05 | 586 | 28 |
| 106 | SD-06 | 670 | 37 |
| 107 | SD-07 | 545 | 32 |

Red light sensitive emulsions

Emulsion A. The aforementioned emulsion was optimally sensitized with sodium thiocyanate, 3-(N-methylsulfonyl) carbamoylethylbenzothiazolium tetrafluoroborate, sulfur and gold sensitizers, and spectral sensitizing dyes SD-01 and SD-02 in a one to four molar ratio of dye.

Emulsion B. The aforementioned emulsion was optimally sensitized like emulsion A, except spectral sensitizing dyes SD-03 and SD-02 were used in a two to one molar ratio.

Emulsion C. The aforementioned emulsion was optimally sensitized like emulsion A, except spectral sensitizing dye SD-04 only was used. Then emulsion A, emulsion B, and the emulsion with SD-04 only were blended together in a five to four to one molar ratio, respectively. The resultant blended emulsion was Emulsion C.

Emulsion D. The aforementioned emulsion was optimally sensitized like emulsion A, except a mixture of spectral sensitizing dyes SD-05, SD-03, SD-02, and D-06 was used in a 36.25 to 36.25 to 17.5 to 10 molar ratio.

Photographic samples 108 to 111 were prepared and tested like photographic sample 101. The wavelength of peak light absorption and the overall half-peak bandwidth of each sample is tabulated in Table II. If more than one peak was present in the absorption curve, the peak wavelength was located by drawing a tie-line between the two peaks and the assigned peak was located closer to the higher peak, weighted proportionally by the absorption peak heights. The overall half-peak bandwidth was then determined using the assigned peak.

TABLE II

| Photographic Sample | Emulsion | Wavelength of Maximum Absorption (nm) | Overall Half-peak Bandwidth (nm) |
|---|---|---|---|
| 108 | A | 653 | 36 |
| 109 | B | 628 | 47 |
| 110 | C | 604 | 83 |
| 111 | D | 609 | 98 |

Green light sensitive emulsions

Silver iodobromide tabular grain emulsions E, F, G, H, I and J were provided having the significant grain characteristics set out in Table III below. Tabular grains accounted for greater than 70 percent of total grain projected area in all instances. Emulsions E through I were each optimally sulfur and gold sensitized. In addition, these emulsions were optimally spectrally sensitized with the following dyes:

Emulsion E contained spectral sensitizing dyes SD-04 and SD-07 in a 1:4.5 molar ratio of dye.

Emulsion F contained spectral sensitizing dyes SD-04 and SD-07 in a 1:4 molar ratio of dye.

Emulsion G contained spectral sensitizing dyes SD-04 and SD-07 in a 1:4.5 molar ratio of dye.

Emulsion H contained spectral sensitizing dyes SD-04 and SD-07 in a 1:7.8 molar ratio of dye.

Emulsion I contained spectral sensitizing dyes SD-04 and SD-07 in a 1:4 molar ratio of dye.

Emulsion J contained spectral sensitizing dyes SD-04 and SD-07 in a 1:4 molar ratio of dye.

TABLE III

Emulsion size and iodide content

| Emulsion | Average grain ECD ($\mu$m) | Average grain thickness, ($\mu$m) | Average Aspect Ratio | Average Iodide Content (mol %) |
|---|---|---|---|---|
| A–D | 4.11 | 0.128 | 32.1 | 3.9 |
| E | 3.85 | 0.138 | 27.9 | 3.6 |
| F | 2.43 | 0.302 | 8.0 | 3.0 |
| G | 5.08 | 0.065 | 78.1 | 1.1 |
| H | 5.33 | 0.070 | 76.1 | 4.1 |
| I | 1.26 | 0.273 | 4.6 | 9.3 |
| J | 2.07 | 0.179 | 11.6 | 8.6 |

Photographic samples 112 to 117 were prepared and tested like samples 108 to 111. Table IV contains tabulations similar to those in Table II.

TABLE IV

| Photographic Sample | Emulsion | Wavelength of Maximum Absorption (nm) | Overall Half-peak Bandwidth (nm) |
|---|---|---|---|
| 112 | E | 544 | 53 |
| 113 | F | 545 | 53 |
| 114 | G | 543 | 65 |
| 115 | H | 544 | 48 |
| 116 | I | 546 | 51 |
| 117 | J | 546 | 64 |

COLOR NEGATIVE ELEMENT PROPERTIES

Photographic Sample 201(c) was prepared by applying the following layers to the transparent film support previously described. The layers were coated in the sequence recited, with the red recording layer unit coated nearest the support.

| | |
|---|---|
| Layer 1: RU | |
| Emulsion A, silver content | (1.076) |
| Development inhibitor releasing coupler D-1 | (0.022) |
| Development inhibitor releasing coupler D-2 | (0.022) |
| Cyan dye forming coupler C-2 | (0.323) |
| Cyan dye-forming magenta colored coupler CM-1 | (0.048) |
| Oxidized developer scavenger S-1 | (0.014) |
| HBS-1 | (0.088) |
| HBS-2 | (0.323) |
| HBS-3 | (0.044) |
| HBS-4 | (0.021) |
| TAI | (0.017) |
| Gelatin | (1.485) |
| Layer 2: IL2 | |
| Oxidized developer scavenger S-1 | (0.075) |
| HBS-4 | (0.113) |
| Gelatin | (0.807) |
| Layer 3: GU | |
| Emulsion E, silver content | (1.291) |
| DIR coupler D-3 | (0.003) |
| Magenta dye forming yellow-colored coupler MM-1 | (0.086) |
| Magenta dye forming coupler M-1 | (0.215) |
| Stabilizer ST-1 | (0.022) |
| Oxidized developer scavenger S-2 | (0.017) |
| HBS-1 | (0.199) |
| HBS-5 | (0.086) |
| TAI | (0.012) |
| Gelatin | (1.560) |
| Layer 4: IL1 | |
| Oxidized developer scavenger S-1 | (0.075) |
| HBS-4 | (0.113) |
| Yellow filter dye YD-1 | (0.161) |
| Gelatin | (0.807) |

Layer 5: BU

This layer unit was comprised of a blue sensitized tabular grain silver iodobromide emulsion having an iodide content of 4.1 mole percent, based on silver. The mean ECD of the emulsion was 3.37 $\mu$m, the average thickness of the tabular grains was 0.14 $\mu$m, and the average aspect ratio of the tabular grains was 24.7. Tabular grains accounted for greater than 70% of the total grain projected area.

| | |
|---|---|
| Emulsion, silver content | (0.592) |
| DIR coupler D-4 | (0.027) |
| Yellow dye forming coupler Y-1 | (0.424) |
| Bleach accelerator coupler B-1 | (0.011) |
| HBS-1 | (0.225) |
| HBS-6 | (0.014) |
| TAI | (0.003) |
| Gelatin | (1.614) |
| Layer 6: SOC | |
| Dye UV-1 | (0.108) |
| Dye UV-2 | (0.108) |
| Unsensitized silver bromide Lippmann emulsion | (0.215) |
| HBS-1 | (0.151) |
| Polymethylmethacrylate matte beads | (0.005) |
| Soluble polymethylmethacrylate matte beads | (0.108) |
| Silicone lubricant | (0.039) |
| Gelatin | (1.237) |

Hardener H-1 was included at the time of coating at 2.00% by weight of total gelatin. Surfactants, lubricants, coating aids, antifoggants, stabilizers, antistatic agents, biostats, biocides, and other addenda chemicals were also added to the various layers of this sample as is commonly practiced in the art.

Sample 202(c) color photographic recording material for color negative development was prepared exactly as above in Sample 201, except where noted below.

| | |
|---|---|
| Layer 1: RU Changes | |
| Cyan dye-forming magenta-colored coupler CM-1 | (0.000) |
| Layer 3: GU Changes | |
| Magenta dye forming yellow-colored coupler MM-1 | (0.000) |

Sample 203(c) color photographic recording material for color negative development was prepared exactly as above in Sample 201, except where noted below.

| | |
|---|---|
| Layer 3: GU Changes | |
| Emulsion E | (0.000) |
| Emulsion F | (1.291) |

Sample 204(c) color photographic recording material for color negative development was prepared exactly as above in Sample 203, except where noted below.

| | |
|---|---|
| Layer 1: RU Changes | |
| Cyan dye-forming magenta colored coupler CM-1 | (0.000) |
| Layer 3: GU Changes | |
| Magenta dye forming yellow-colored coupler MM-1 | (0.000) |

Sample 205(c) color photographic recording material for color negative development was prepared exactly as above in Sample 201, except where noted below.

| | |
|---|---|
| Layer 3: RU Changes | |
| Emulsion A | (0.000) |
| Emulsion B | (1.076) |

Sample 206(c) color photographic recording material for color negative development was prepared exactly as above in Sample 205, except where noted below.

| | |
|---|---|
| Layer 1: RU Changes | |
| Cyan dye-forming magenta-colored coupler CM-1 | (0.000) |
| Layer 3: GU Changes | |
| Magenta dye forming yellow-colored coupler MM-1 | (0.000) |

Sample 207(c) color photographic recording material for color negative development was prepared exactly as above in Sample 205, except where noted below.

| | |
|---|---|
| Layer 3: GU Changes | |
| Emulsion E | (0.000) |
| Emulsion F | (1.291) |

Sample 208(c) color photographic recording material for color negative development was prepared exactly as above in Sample 207, except where noted below.

| | |
|---|---|
| Layer 1: RU Changes | |
| Cyan dye-forming magenta-colored coupler CM-1 | (0.000) |
| Layer 3: GU Changes | |
| Magenta dye-forming yellow-colored coupler MM-1 | (0.000) |

Sample 209(c) color photographic recording material for color negative development was prepared exactly as above in Sample 201, except where noted below.

| | |
|---|---|
| Layer 3: RU Changes | |
| Emulsion A | (0.000) |
| Emulsion C | (1.076) |

Sample 210(c) color photographic recording material for color negative development was prepared exactly as above in Sample 203, except where noted below.

| | |
|---|---|
| Layer 1: RU Changes | |
| Cyan dye-forming magenta-colored coupler CM-1 | (0.000) |
| Layer 3: GU Changes | |
| Magenta dye forming yellow-colored coupler MM-1 | (0.000) |

Sample 211(c) color photographic recording material for color negative development was prepared exactly as above in Sample 210, except where noted below.

| | |
|---|---|
| Layer 3: GU Changes | |
| Emulsion E | (0.000) |
| Emulsion G | (1.291) |

Sample 212(c) color photographic recording material for color negative development was prepared exactly as above in sample 210, except where noted below.

| | |
|---|---|
| Layer 3: GU Changes | |
| Emulsion E | (0.000) |
| Emulsion H | (1.291) |

Sample 213(c) color photographic recording material for color negative development was prepared exactly as above in Sample 209, except where noted below.

| Layer 3: GU Changes | |
|---|---|
| Emulsion E | (0.000) |
| Emulsion F | (1.291) |

Sample 214(e) color photographic recording material for color negative development was prepared exactly as above in Sample 213, except where noted below.

| Layer 1: RU Changes | |
|---|---|
| Cyan dye-forming magenta-colored coupler CM-1 | (0.000) |
| Layer 3: GU Changes | |
| Magenta dye-forming yellow-colored coupler MM-1 | (0.000) |

Sample 215(e) color photographic recording material for color negative development was prepared exactly as above in Sample 214, except where noted below.

| Layer 3: GU Changes | |
|---|---|
| Emulsion F | (0.000) |
| Emulsion I | (1.291) |

Sample 216(e) color photographic recording material for color negative development was prepared exactly as above in Sample 214, except where noted below.

| Layer 3: GU Changes | |
|---|---|
| Emulsion F | (0.000) |
| Emulsion J | (1.291) |

Sample 217(c) color photographic recording material for color negative development was prepared exactly as above in Sample 201, except where noted below.

| Layer 3: RU Changes | |
|---|---|
| Emulsion A | (0.000) |
| Emulsion D | (1.076) |

Sample 218(c) color photographic recording material for color negative development was prepared exactly as above in Sample 217, except where noted below.

| Layer 1: RU Changes | |
|---|---|
| Cyan dye-forming magenta colored coupler CM-1 | (0.000) |
| Layer 3: GU Changes | |
| Magenta dye-forming yellow-colored coupler MM-1 | (0.000) |

Sample 219(c) color photographic recording material for color negative development was prepared exactly as above in Sample 218, except where noted below.

| Layer 3: GU Changes | |
|---|---|
| Emulsion E | (0.000) |
| Emulsion G | (1.291) |

Sample 220(c) color photographic recording material for color negative development was prepared exactly as above in Sample 217, except where noted below.

| Layer 3: GU Changes | |
|---|---|
| Emulsion E | (0.000) |
| Emulsion F | (1.291) |

Sample 221(e) color photographic recording material for color negative development was prepared exactly as above in Sample 220, except where noted below.

| Layer 1: RU Changes | |
|---|---|
| Cyan dye-forming magenta-colored coupler CM-1 | (0.000) |
| Layer 3: GU Changes | |
| Magenta dye-forming yellow-colored coupler MM-1 | (0.000) |

Sample 222(e) color photographic recording material for color negative development was prepared exactly as above in Sample 221, except where noted below.

| Layer 3: GU Changes | |
|---|---|
| Emulsion F | (0.000) |
| Emulsion I | (1.291) |

The sensitivities over the visible spectrum of the individual color units of the photographic recording materials, Samples 201–222, were determined in 10-nm increments using nearly monochromatic light of carefully calibrated output from 360 to 710 nm. Photographic recording materials Samples 201–222 were individually exposed for 1/25 of a second to white light from a tungsten light source of 3200K color temperature that was filtered by a Daylight Va filter to 5500K, by 1.4 neutral density, and by a monochromator with a 4-nm bandpass resolution through a graduated 0–4.0 density step tablet to determine their speed. The samples were then processed using the KODAK Flexicolor C-41™ color negative process, as described by *The British Journal of Photography Annual of* 1988, pp. 196–198, with fresh, unseasoned processing chemical solutions. Another description of the use of the Flexicolor C-41 process is provided by *Using Kodak Flexicolor Chemicals*, Kodak Publication No. Z-131, Eastman Kodak Company, Rochester, N.Y.

Following processing and drying, Samples 201–222 were subjected to Status M densitometry and their sensitometric performance over the visible spectrum was characterized. The exposure required to produce a density increase of 0.15 above $D_{min}$ was calculated for the red-light sensitive color recording unit at each 10-nm increment exposed, and the quantity—the logarithm of the reciprocal of the required exposure in ergs/square centimeter, multiplied by 100, is reported as speed in Table V.

TABLE V

| Sample | RU emulsion | Half-peak band-width (nm) | RU λmax (nm) | Colored Masking Couplers | GU emulsion | GU emulsion ECD/t | RUS1 RU S2 | RU S1 Speed at 560 nm | RU S2 Speed at λmax |
|---|---|---|---|---|---|---|---|---|---|
| 201(c) | A | 36 | 650 | YES | E | 28 | 0.58 | 179.9 | 308.6 |
| 202(c) | A | 36 | 650 | NO | E | 28 | 0.62 | 191.7 | 303.9 |
| 203(c) | A | 36 | 650 | YES | F | 8 | 0.63 | 196.7 | 311.8 |
| 204(c) | A | 36 | 650 | NO | F | 8 | 0.69 | 211.2 | 307.1 |
| 205(c) | B | 47 | 630 | YES | E | 28 | 0.65 | 196.2 | 302.8 |
| 206(c) | B | 47 | 630 | NO | E | 28 | 0.70 | 206.5 | 297.1 |
| 207(c) | B | 47 | 630 | YES | F | 8 | 0.70 | 213.3 | 305.4 |
| 208(c) | B | 47 | 630 | NO | F | 8 | 0.76 | 228.7 | 300.6 |
| 209(c) | C | 83 | 630 | YES | E | 28 | 0.73 | 212.4 | 290.2 |
| 210(c) | C | 83 | 590 | NO | E | 28 | 0.78 | 224.2 | 287.5 |
| 211(c) | C | 83 | 590 | NO | G | 78 | 0.77 | 212.4 | 274.0 |
| 212(c) | C | 83 | 590 | NO | H | 76 | 0.73 | 201.6 | 275.1 |
| 213(c) | C | 83 | 630 | YES | F | 8 | 0.77 | 228.6 | 295.0 |
| 214(e) | C | 83 | 590 | NO | F | 8 | 0.83 | 243.2 | 291.5 |
| 215(e) | C | 83 | 590 | NO | I | 4.6 | 0.81 | 240.6 | 294.4 |
| 216(e) | C | 83 | 590 | NO | J | 12 | 0.82 | 237.4 | 291.0 |
| 217(c) | D | 98 | 610 | YES | E | 28 | 0.74 | 202.7 | 274.0 |
| 218(c) | D | 98 | 610 | NO | E | 28 | 0.78 | 213.2 | 272.7 |
| 219(c) | D | 98 | 610 | NO | G | 78 | 0.79 | 204.4 | 258.8 |
| 220(c) | D | 98 | 610 | YES | F | 8 | 0.79 | 218.6 | 277.1 |
| 221(e) | D | 98 | 610 | NO | F | 8 | 0.84 | 232.5 | 275.1 |
| 222(e) | D | 98 | 610 | NO | I | 4.6 | 0.83 | 228.6 | 275.4 |

It is noted from the RU S1÷RU S2 column that none of the controls satisfy a 560 nm speed that is at least 80 percent of maximum speed (RU λmax). The differences in measured speed correspond to differences in RU sensitizing dye absorptions at 560 nm and λmax. The bold face numbers in Table V point out where the comparative samples fail to satisfy the requirements of the invention. Notice that each comparative failure to satisfy RU S1÷RU S2 requirements is accompanied by a failure to satisfy one or more of the following requirements: RU spectral sensitizing dye overall half-peak bandwidth of at least 50 nm and preferably 75 nm, the absence of colored masking couplers, and average tabular grain emulsion aspect ratios in GU of less than 15.

PLURAL EMULSION LAYER

BLUE, GREEN AND RED RECORDING LAYER UNIT ELEMENTS

COMPONENT PROPERTIES

Red light sensitive emulsions

Silver iodobromide tabular grain emulsions K, L, M and N were provided having the significant grain characteristics set out in Table VI below. Tabular grains accounted for greater than 70 percent of total grain projected area in all instances. Emulsions K through M were each optimally sulfur and gold sensitized. In addition, these emulsions were optimally spectrally sensitized with SD-11, SD-05, SD-03, SD-02, and SD-06 in a 40:31:18:7:4 molar ratio. Emulsions K through N were subsequently coated and evaluated like photographic sample 101. The wavelength of peak light absorption for all emulsions was around 570 nm, and the half-peak absorption bandwidth was over 100 nm.

TABLE VI

Emulsion size and iodide content

| Emulsion | Average grain ECD (μm) | Average grain thickness, (μm) | Average Aspect Ratio | Average Iodide Content (mol %) |
|---|---|---|---|---|
| K | 2.16 | 0.116 | 18.6 | 3.9 |
| L | 1.31 | 0.096 | 13.6 | 3.7 |
| M | 0.90 | 0.123 | 7.3 | 3.7 |
| N | 0.52 | 0.119 | 4.4 | 3.7 |

Green light sensitive emulsions

Silver iodobromide tabular grain emulsions O, P, Q, R, S, T and U were provided having the significant grain characteristics set out in VII below. Tabular grains accounted for greater than 70 percent of total grain projected area in all instances. Emulsions O through U were each optimally sulfur and gold sensitized. In addition, emulsions O through S were optimally spectrally sensitized with SD-04 and SD-07 in a one to four and a half molar ratio of dye. Emulsion T was optimally sulfur and gold sensitized and spectrally sensitized with SD-04 and SD-07 in a 1:7.8 molar ratio. Emulsion U was optimally sulfur and gold sensitized and spectrally sensitized with SD-04 and SD-07 in a one to six molar ratio. Emulsion O through U were subsequently coated and evaluated like photographic sample 101. The wavelength of peak light absorption for all emulsions was around 545 nm, and the wavelength at half of the maximum absorption on the bathochromic side was around 575 nm for all emulsions.

TABLE VII

Emulsion size and iodide content

| Emulsion | Average grain ECD (μm) | Average grain thickness, (μm) | Average Aspect Ratio | Average Iodide Content (mol %) |
|---|---|---|---|---|
| O | 1.40 | 0.298 | 4.7 | 3.6 |
| P | 1.10 | 0.280 | 3.9 | 3.6 |
| Q | 0.90 | 0.123 | 7.3 | 3.7 |
| R | 0.52 | 0.119 | 4.4 | 3.7 |

TABLE VII-continued

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| S | 5.08 | 0.65 | 78.1 | 1.1 |
| T | 1.94 | .056 | 34.6 | 4.8 |
| U | 1.03 | .057 | 18.0 | 4.8 |

Blue light sensitive emulsions

Silver iodobromide tabular grain emulsions V, W, X and Y were provided having the significant grain characteristics set out in Table VIII below. Tabular grains accounted for greater than 70 percent of total grain projected area in all instances. Emulsions V through Y were each optimally sulfur and gold sensitized. In addition, these emulsions were optimally spectrally sensitized with SD-08, SD-09 and SD-10 in a 45:32:23 molar ratio.

TABLE VIII

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| V | 4.11 | 0.128 | 32.1 | 3.9 |
| W | 2.16 | 0.116 | 18.6 | 3.9 |
| X | 1.31 | 0.096 | 13.6 | 3.7 |
| Y | 0.52 | 0.119 | 4.4 | 3.7 |

Red light sensitive emulsions

Silver iodobromide tabular grain emulsions AA, BB, CC and DD were provided having the significant grain characteristics set out in Table IX below. Tabular grains accounted for greater than 70 percent of total grain projected area in all instances. Emulsions AA through DD were each optimally sulfur and gold sensitized. In addition, these emulsions were optimally spectrally sensitized with SD-03 and SD-02 in a 2:1 molar ratio. Emulsions AA through DD were subsequently coated and evaluated like photographic sample 101. The wavelength of peak light absorption for all emulsions was around 628 nm, and the half-peak absorption bandwidth was around 44 nm.

TABLE IX

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| AA | 0.66 | 0.120 | 5.5 | 4.1 |
| BB | 0.55 | 0.083 | 6.6 | 1.5 |
| CC | 1.30 | 0.120 | 10.8 | 4.1 |
| DD | 2.61 | 0.117 | 22.3 | 3.7 |

Green light sensitive emulsions

Silver iodobromide tabular grain emulsions EE, FF, GG and HH were provided having the significant grain characteristics set out in Table X below. Tabular grains accounted for greater than 70 percent of total grain projected area in all instances. Emulsions EE through HH were each optimally sulfur and gold sensitized. In addition, emulsions EE through HH were optimally spectrally sensitized with SD-04 and SD-07 in a 1:4.5 molar ratio of dye. Emulsions EE through HH were subsequently coated and evaluated like photo-graphic sample 101. The wavelength of peak light absorption for all emulsions was around 545 nm, and the wavelength at half of the maximum absorption on the bathochromic side was about 575 nm for all emulsions.

TABLE X

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EE | 1.22 | 0.111 | 11.0 | 4.1 |
| FF | 2.49 | 0.137 | 18.2 | 4.1 |
| GG | 0.81 | 0.120 | 6.8 | 2.6 |
| HH | 0.92 | 0.115 | 8.0 | 4.1 |

Blue light sensitive emulsions

Silver iodobromide tabular grain emulsions II, JJ and KK were provided having the significant grain characteristics set out in Table XI below. Tabular grains accounted for greater than 70 percent of total grain projected area in all instances. Emulsion LL, a thick conventional grain was also provided. Emulsions II through LL were each optimally sulfur and gold sensitized. In addition, these emulsions were optimally spectrally sensitized with SD-08 and SD-09 in a 1:1 molar ratio.

TABLE XI

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| II | 0.55 | 0.083 | 6.6 | 1.5 |
| JJ | 1.25 | 0.137 | 9.1 | 4.1 |
| KK | 0.77 | 0.140 | 5.5 | 1.5 |
| LL | 1.04 | Not applicable | Not applicable | 9.0 |

COLOR NEGATIVE ELEMENT PROPERTIES

The slower, mid-speed and faster emulsion layers within each of the blue (BU), green (GU) and red (RU) recording layer units are indicated by the prefix S, M and F, respectively.

Sample 301(c)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| Layer 1: AHU | |
|---|---|
| Black colloidal silver sol | (0.107) |
| UV-1 | (0.075) |
| UV-2 | (0.075) |
| Oxidized developer scavenger S-1 | (0.161) |
| Compensatory printing density cyan dye CD-1 | (0.034) |
| Compensatory printing density magenta dye MD-1 | (0.013) |
| Compensatory printing density yellow dye MM-2 | (0.095) |
| HBS-1 | (0.105) |
| HBS-2 | (0.433) |
| HBS-4 | (0.013) |
| Disodium salt of 3,5-disulfocatechol | (0.215) |
| Gelatin | (2.152) |

Layer 2: SRU

This layer was comprised of a blend of a lower and higher (lower and higher grain ECD) sensitivity, red-sensitized tabular silver iodobromide emulsions respectively.

| | |
|---|---|
| Emulsion BB, silver content | (0.355) |
| Emulsion AA, silver content | (0.328) |
| Bleach accelerator releasing coupler B-1 | (0.075) |
| Development inhibitor releasing coupler D-5 | (0.015) |
| Cyan dye forming coupler C-1 | (0.359) |
| HBS-2 | (0.405) |
| HBS-6 | (0.098) |
| TAI | (0.011) |
| Gelatin | (1.668) |
| Layer 3: MRU | |
| Emulsion CC, silver content | (1.162) |
| Bleach accelerator releasing coupler B-1 | (0.005) |
| Development inhibitor releasing coupler D-5 | (0.016) |
| Cyan dye forming magenta colored coupler CM-1 | (0.059) |
| Cyan dye forming coupler C-1 | (0.207) |
| HBS-2 | (0.253) |
| HBS-6 | (0.007) |
| TAI | (0.019) |
| Gelatin | (1.291) |
| Layer 4: FRU | |
| Emulsion DD, silver content | (1.060) |
| Bleach accelerator releasing coupler B-1 | (0.005) |
| Development inhibitor releasing coupler D-5 | (0.027) |
| Development inhibitor releasing coupler D-1 | (0.048) |
| Cyan dye forming magenta colored coupler CM-1 | (0.022) |
| Cyan dye forming coupler C-1 | (0.323) |
| HBS-1 | (0.194) |
| HBS-2 | (0.274) |
| HBS-6 | (0.007) |
| TAI | (0.010) |
| Gelatin | (1.291) |
| Layer 5: Interlayer | |
| Oxidized developer scavenger S-1 | (0.086) |
| HBS-4 | (0.129) |
| Gelatin | (0.538) |

Layer 6: SGU

This layer was comprised of a blend of a lower and higher (lower and higher grain ECD) sensitivity, green-sensitized tabular silver iodobromide emulsions respectively.

| | |
|---|---|
| Emulsion GG, silver content | (0.251) |
| Emulsion HH, silver content | (0.110) |
| Magenta dye forming yellow colored coupler MM-1 | (0.054) |
| Magenta dye forming coupler M-1 | (0.339) |
| Stabilizer ST-1 | (0.034) |
| HBS-1 | (0.413) |
| TAI | (0.006) |
| Gelatin | (1.184) |

Layer 7: MGU

This layer was comprised of a blend of a lower and higher (lower and higher grain ECD) sensitivity, green-sensitized tabular silver iodobromide emulsions.

| | |
|---|---|
| Emulsion HH, silver content | (0.091) |
| Emulsion EE, silver content | (1.334) |
| Development inhibitor releasing coupler D-6 | (0.032) |
| Magenta dye forming yellow colored coupler MM-1 | (0.118) |
| Magenta dye forming coupler M-1 | (0.087) |
| Oxidized developer scavenger S-2 | (0.018) |
| HBS-1 | (0.315) |

-continued

| | |
|---|---|
| HBS-2 | (0.032) |
| Stabilizer ST-1 | (0.009) |
| TAI | (0.023) |
| Gelatin | (1.668) |
| Layer 8: FGU | |
| Emulsion FF, silver content | (0.909) |
| Development inhibitor releasing coupler D-3 | (0.003) |
| Development inhibitor releasing coupler D-7 | (0.032) |
| Oxidized developer scavenger S-2 | (0.023) |
| Magenta dye forming yellow colored coupler MM-1 | (0.054) |
| Magenta dye forming coupler M-1 | (0.113) |
| HBS-1 | (0.216) |
| HBS-2 | (0.064) |
| Stabilizer ST-1 | (0.011) |
| TAI | (0.011) |
| Gelatin | (1.405) |
| Layer 9: Yellow Filter Layer | |
| Yellow filter dye YD-1 | (0.054) |
| Oxidized developer scavenger S-1 | (0.086) |
| HBS-4 | (0.129) |
| Gelatin | (0.538) |

Layer 10: SBU

This layer was comprised of a blend of a lower, medium, and higher (lower, medium, and higher grain ECD) sensitivity, blue-sensitized tabular silver iodobromide emulsions.

| | |
|---|---|
| Emulsion II, silver content | (0.140) |
| Emulsion KK, silver content | (0.247) |
| Emulsion JJ, silver content | (0.398) |
| Development inhibitor releasing coupler D-5 | (0.027) |
| Development inhibitor releasing coupler D-4 | (0.054) |
| Yellow dye forming coupler Y-1 | (0.915) |
| Cyan dye forming coupler C-1 | (0.027) |
| Bleach accelerator releasing coupler B-1 | (0.011) |
| HBS-1 | (0.538) |
| HBS-2 | (0.108) |
| HBS-6 | (0.014) |
| TAI | (0.014) |
| Gelatin | (2.119) |

Layer 11: FBU

This layer was comprised of a blue-sensitized tabular silver iodobromide emulsion containing 9.0 M % iodide, based on silver.

| | |
|---|---|
| Emulsion LL, silver content | (0.699) |
| Unsensitized silver bromide Lippmann emulsion | (0.054) |
| Yellow dye forming coupler Y-1 | (0.473) |
| Development inhibitor releasing coupler D-4 | (0.086) |
| Bleach accelerator releasing coupler B-1 | (0.005) |
| HBS-1 | (0.280) |
| HBS-6 | (0.007) |
| TAI | (0.012) |
| Gelatin | (1.183) |
| Layer 12: Ultraviolet Filter Layer | |
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |
| Layer 13: Protective Overcoat Layer | |
| Polymethylmethacrylate matte beads | (0.005) |
| Soluble polymethylmethacrylate matte beads | (0.108) |
| Silicone lubricant | (0.039) |

-continued

| | |
|---|---|
| Gelatin | (0.882) |

This film was hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 302(c)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| Layer 1: AHU | |
|---|---|
| Black colloidal silver sol | (0.151) |
| UV-1 | (0.075) |
| UV-2 | (0.107) |
| Oxidized developer scavenger S-1 | (0.161) |
| Compensatory printing density cyan dye CD-1 | (0.016) |
| Compensatory printing density magenta dye MD-1 | (0.038) |
| Compensatory printing density yellow dye MM-2 | (0.285) |
| HBS-1 | (0.105) |
| HBS-2 | (0.341) |
| HBS-4 | (0.038) |
| HBS-7 | (0.011) |
| Disodium salt of 3,5-disulfocatechol | (0.228) |
| Gelatin | (2.044) |

Layer 2: SRU

This layer was comprised of a blend of a lower and higher (lower and higher grain ECD) sensitivity, red-sensitized tabular silver iodobromide emulsions.

| | |
|---|---|
| Emulsion M, silver content | (0.430) |
| Emulsion N, silver content | (0.323) |
| Bleach accelerator releasing coupler B-1 | (0.057) |
| Oxidized developer scavenger S-3 | (0.183) |
| Development inhibitor releasing coupler D-7 | (0.013) |
| Cyan dye forming coupler C-1 | (0.344) |
| Cyan dye forming coupler C-2 | (0.038) |
| HBS-2 | (0.026) |
| HBS-5 | (0.118) |
| HBS-6 | (0.120) |
| TAI | (0.012) |
| Gelatin | (1.679) |
| Layer 3: MRU | |
| Emulsion L, silver content | (1.076) |
| Bleach accelerator releasing coupler B-1 | (0.022) |
| Development inhibitor releasing coupler D-1 | (0.011) |
| Development inhibitor releasing coupler D-7 | (0.013) |
| Oxidized developer scavenger S-3 | (0.183) |
| Cyan dye forming coupler C-1 | (0.086) |
| Cyan dye forming coupler C-2 | (0.086) |
| KBS-1 | (0.044) |
| KBS-2 | (0.026) |
| HBS-5 | (0.097) |
| KBS-6 | (0.074) |
| TAI | (0.017) |
| Gelatin | (1.291) |
| Layer 4: FRU | |
| Emulsion K, silver content | (1.291) |
| Development inhibitor releasing coupler D-1 | (0.011) |

-continued

| | |
|---|---|
| Development inhibitor releasing coupler D-7 | (0.011) |
| Oxidized developer scavenger S-1 | (0.014) |
| Cyan dye forming coupler C-1 | (0.065) |
| Cyan dye forming coupler C-2 | (0.075) |
| HBS-1 | (0.044) |
| KBS-2 | (0.022) |
| HBS-4 | (0.021) |
| HBS-5 | (0.161) |
| TAI | (0.021) |
| Gelatin | (1.076) |
| Layer 5: Interlayer | |
| Oxidized developer scavenger S-1 | (0.086) |
| HBS-4 | (0.129) |
| Gelatin | (0.538) |

Layer 6: SGU

This layer was comprised of a blend of a lower and higher (lower and higher grain ECD) sensitivity, green-sensitized tabular silver iodobromide emulsions.

| | |
|---|---|
| Emulsion U, silver content | (0.161) |
| Emulsion R, silver content | (0.269) |
| Bleach accelerator releasing coupler B-1 | (0.012) |
| Development inhibitor releasing coupler D-7 | (0.011) |
| Oxidized developer scavenger S-3 | (0.183) |
| Magenta dye forming coupler M-1 | (0.301) |
| Stabilizer ST-1 | (0.060) |
| HBS-1 | (0.241) |
| HBS-2 | (0.022) |
| KBS-6 | (0.061) |
| TAI | (0.003) |
| Gelatin | (1.106) |
| Layer 7: MGU | |
| Emulsion T, silver content | (0.968) |
| Bleach accelerator releasing coupler B-1 | (0.005) |
| Development inhibitor releasing coupler D-1 | (0.011) |
| Development inhibitor releasing coupler D-7 | (0.011) |
| Oxidized developer scavenger S-1 | (0.011) |
| Oxidized developer scavenger S-3 | (0.183) |
| Magenta dye forming coupler M-1 | (0.113) |
| Stabilizer ST-1 | (0.023) |
| HBS-1 | (0.133) |
| HBS-2 | (0.022) |
| HBS-4 | (0.016) |
| HBS-6 | (0.053) |
| TAI | (0.016) |
| Gelatin | (1.399) |
| Layer 8: FGU | |
| Emulsion S, silver content | (0.968) |
| Development inhibitor releasing coupler D-1 | (0.009) |
| Development inhibitor releasing coupler D-7 | (0.011) |
| Oxidized developer scavenger S-1 | (0.011) |
| Magenta dye forming coupler M-1 | (0.097) |
| Stabilizer ST-1 | (0.029) |
| HBS-1 | (0.112) |
| HBS-2 | (0.022) |
| HBS-4 | (0.016) |
| TAI | (0.018) |
| Gelatin | (1.399) |
| Layer 9: Yellow Filter Layer | |
| Yellow filter dye YD-1 | (0.032) |
| Oxidized developer scavenger S-1 | (0.086) |
| HBS-4 | (0.129) |
| Gelatin | (0.646) |

Layer 10: SBU

This layer was comprised of a blend of a lower, medium, and higher (lower, medium, and higher grain ECD) sensitivity, blue-sensitized tabular silver iodobromide emulsions.

| | |
|---|---|
| Emulsion W, silver content | (0.398) |
| Emulsion X, silver content | (0.247) |
| Emulsion Y, silver content | (0.215) |
| Bleach accelerator releasing coupler B-1 | (0.003) |
| Development inhibitor releasing coupler D-7 | (0.011) |
| Oxidized developer scavenger S-3 | (0.183) |
| Yellow dye forming coupler Y-1 | (0.710) |
| HBS-2 | (0.022) |
| HBS-5 | (0.151) |
| HBS-6 | (0.050) |
| TAI | (0.014) |
| Gelatin | (1.872) |
| Layer 11: FBU | |
| Emulsion V, silver content | (0.699) |
| Bleach accelerator releasing coupler B-1 | (0.005) |
| Development inhibitor releasing coupler D-7 | (0.013) |
| Yellow dye forming coupler Y-1 | (0.140) |
| HBS-2 | (0.026) |
| HBS-5 | (0.118) |
| HBS-6 | (0.007) |
| TAI | (0.011) |
| Gelatin | (1.291) |
| Layer 12: Protective Overcoat Layer | |
| Poly(methyl methacrylate) matte beads | (0.005) |
| Soluble poly(methyl methacrylate) matte beads | (0.054) |
| Unsensitized silver bromide Lippmann emulsion | (0.215) |
| Dye UV-1 | (0.108) |
| Dye UV-2 | (0.216) |
| Silicone lubricant | (0.040) |
| HBS-1 | (0.151) |
| HBS-7 | (0.108) |
| Gelatin | (1.237) |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 303(e) color photographic recording material for color negative development was prepared exactly as above in Sample 302(c), except where noted below.

| | |
|---|---|
| Layer 6: SGU Changes | |
| Emulsion U | (0.000) |
| Emulsion Q | (0.161) |
| Layer 7: MGU Changes | |
| Emulsion T | (0.000) |
| Emulsion P | (0.968) |
| Layer 8: FGU Changes | |
| Emulsion S | (0.000) |
| Emulsion O | (0.968) |

In order to establish the utility of the photographic recording materials, each of the color negative film samples 301–303 samples was exposed to white light from a tungsten source filtered by a Daylight Va filter to 5500K at 1/500th of a second through 1.2 inconel neutral density and a 0–4 log E graduated tablet with 0.20 density increment steps. The color reversal film, KODAK Ektachrome™ ELITE II 100 Film (designated Sample 401), was exposed by white light from another tungsten source filtered to 5500K and through a 0–4 density step tablet for 1/5 of a second, in order to optimally determine the characteristic curve of the photographic recording material. The exposed film samples were processed through the KODAK Flexicolor™ C-41 color negative process. The film samples were then subjected to Status M densitometry and the characteristic curves and photographic performance metrics were determined.

Gamma (γ) for each color record is the maximum slope of the characteristic curve between a point on the curve lying at a density of 0.15 above minimum density ($D_{min}$) and a point on the characteristic curve at 0.9 log E higher exposure level, where E is exposure in lux-seconds. The gamma for each Sample's characteristic curve color records was determined by measuring the indicated curve segments with a Kodak Model G gradient meter. The exposure latitude, indicating the exposure range of a characteristic curve segment over which the instantaneous gamma was at least 25% of the gamma as defined above, was also determined. The observed values of gamma and latitude are reported in Table XII.

TABLE XII

| | Status M Gamma | | | Latitude (log lux-s) | | |
|---|---|---|---|---|---|---|
| Sample | R | G | B | R | G | B |
| 1. 301(c) | 0.67 | 0.63 | 0.77 | 3.4+ | 3.4+ | 3.4+ |
| 2. 302(c) | 0.71 | 0.36 | 0.90 | 3.2+ | 3.6+ | 3.1 |
| 4. 303(e) | 0.67 | 0.66 | 0.83 | 3.4+ | 3.2 | 3.2 |
| 5. 401(c) | 1.52 | 2.26 | 1.92 | 2.3 | 2.3 | 2.6 |

The sensitivities over the visible spectrum of the individual color units of the photographic recording materials, Samples 301–303, were determined in 5-nm increments using nearly monochromatic light of carefully calibrated output from 360 to 715 nm. Photographic recording materials, Samples 301–303, were individually exposed for 1/100 of a second to white light from a tungsten light source of 3000K color temperature that was filtered by a Daylight Va filter to 5500K and by a monochromator with a 4-nm bandpass resolution through a graduated 0–4.0 density step tablet with 0.3-density step increments to determine their speed. The samples were then processed using the KODAK Flexicolor C-41™ color negative process.

Following processing and drying, Samples 301–303 were subjected to Status M densitometry and their sensitometric performance over the visible spectrum was characterized. The exposure required to produce a density increase of 0.15 above $D_{min}$ was determined for the color recording units at each 5-nm increment exposed. Speed is reported as the logarithm of the reciprocal of the required exposure in ergs/square centimeter, multiplied by 100, for the red sensitive units in Table XIII.

The spectral sensitivity response of the photographic recording materials was also used to determine the relative colorimetric accuracy of color negative materials Samples 301–303 in recording a particular diverse set of 200 different color patches according to the method disclosed by Giorgianni et al, in U.S. Pat. No. 5,582,961. The computed color error variance is included in Table XIII. This error value relates to the color difference between the CIELAB space coordinates of the specified set of test colors and the space coordinates resulting from a specific transformation of the test colors as rendered by the film. In particular, the test patch input spectral reflectance values for a given light source are convolved with the sample photographic materials' spectral sensitivity response to estimate colorimetric recording capability. It should be noted that the computed color error is sensitive to the responses of all three input color records, and an improved response by one record may not overcome the responses of one or two other limiting color records. A color error difference of at least 1 unit corresponds to significant difference in color recording accuracy.

In Table XIII the bold face numbers in Table XIII point out where the comparative samples fail to satisfy the requirements of the invention. It is noted from the RU S1÷RU S2 column that neither of the controls satisfies a 560 nm speed that is at least 80 percent of maximum speed. The differences in measured speed correspond to differences in RU sensitizing dye absorptions at 560 nm and λmax. When RU spectral sensitizing dye overall half-peak bandwidth is at least 50 nm and preferably 75 nm, RU λmax is less than about 600 nm, and colored masking couplers are absent, a color error substantially lower than the value of 10 results, which is indicative of much higher color recording fidelity than for a conventional color negative film intended for optical printing, such Sample 301c. When the GU aspect ratio requirement is met, significantly improved 560-nm and λmax sensitivity is demonstrated by the element, with no meaningful change in color recording accuracy. This demonstrates that the samples satisfying the requirements of the invention are better suited for providing cyan dye image records for digital image management that better match human visual perception.

TABLE XIII

| Sample | Fast layer RU emulsion | Half-peak band-width (nm) | RU λmax (nm) | Colored Masking Couplers | FGU emulsion | Fast layer GU emulsion ECD/t | RUS1 / RU S2 | RU S1 Speed at 560 nm | RU S2 Speed at λmax | Color error |
|---|---|---|---|---|---|---|---|---|---|---|
| 301(c) | B | 44 | 625 | YES | FF | 18 | 0.48 | 126.7 | 265.1 | 10.0 |
| 302(c) | D | 98 | 595 | NO | S | 78 | 0.75 | 178.9 | 239.1 | 3.5 |
| 303(e) | D | 98 | 595 | NO | O | 4.7 | 0.85 | 212.1 | 249.7 | 3.0 |

The invention has been described in detail with particular reference to preferred embodiments thereof, but it will be understood that variations and modifications can be effected within the spirit and scope of the invention.

What is claimed is:

1. A color negative film comprised of a support and, coated on the support, a blue recording emulsion layer unit capable of forming a dye image of a first hue, a green recording emulsion layer unit capable of forming a dye image of a second hue, and, located between the support and the green recording layer unit, a red recording emulsion layer unit capable of forming a dye image of a third hue, wherein, colored masking couplers are absent from the recording layer units, tabular grain silver halide emulsions sensitized to the green and red are employed in the green and red recording layer units, respectively, the tabular grain emulsions in the green recording layer unit have an average aspect ratio of less than 15, and spectral sensitizing dye in the red recording layer unit exhibits an overall half-peak absorption bandwidth of at least 50 nm bridging the green and red regions of the spectrum, with absorption at 560 nm being in the range of from 80 to 95 percent of maximum absorption, which is located in the spectral region of from 575 to 710 nm.

2. A color negative film comprised of a support and, coated on the support, a blue recording emulsion layer unit containing at least one yellow dye-forming coupler, a green recording emulsion layer unit containing at least one magenta dye-forming coupler, and, located between the support and the green recording layer unit, a red recording emulsion layer unit containing at least one cyan dye-forming coupler, and spectrally sensitized tabular grain silver halide emulsions in the green and red recording layer units, wherein, colored masking couplers are absent from the recording layer units, tabular grain silver halide emulsions are employed in the green and red recording layer units, the tabular grain emulsions in the green recording layer unit have an average aspect ratio of less than 15, and spectral sensitizing dye in the red recording layer unit exhibits an overall half-peak absorption bandwidth of at least 50 nm bridging the green and red regions of the spectrum, with absorption at 560 nm being in the range of from 80 to 95 percent of maximum absorption, which is located in the spectral region of from 575 to 710 nm.

3. A color negative film according to claim 2 wherein the spectral sensitizing dye in the red recording layer unit exhibits an overall half-peak absorption bandwidth of at least 75 nm.

4. A color negative film according to claim 2 wherein the tabular grain silver halide emulsions employed in the green recording layer unit have an average aspect ratio of at least 5.

5. A color negative film according to claim 2 wherein tabular grain silver halide emulsions employed in the red recording layer unit exhibit an average aspect ratio of greater than 15.

6. A color negative film according to claim 5 wherein the tabular grain silver halide emulsions employed in the red recording layer unit exhibit an average aspect ratio of at least 20.

7. A color negative film according to claim 2 wherein the blue, green and red recording layer units contain silver iodobromide emulsions, the blue recording layer unit is coated farther from the support to receive exposing radiation prior to the green and red recording layer units, and a yellow filter is interposed between the blue and the green and red recording layer units.

* * * * *